United States Patent [19]

Wagner et al.

[11] Patent Number: 4,795,937

[45] Date of Patent: Jan. 3, 1989

[54] SPARK PLUG WITH COMBINED SURFACE AND AIR SPARK PATHS

[75] Inventors: Eberhard P. Wagner, Stuttgart; Rudolf Maly, Sindelfingen; Otto Löffler, Stuttgart; Werner Niessner, Steinheim, all of Fed. Rep. of Germany

[73] Assignee: Beru Ruprecht GmbH & Co. KG, Ludwigsburg, Fed. Rep. of Germany

[21] Appl. No.: 939,863

[22] Filed: Dec. 9, 1986

[30] Foreign Application Priority Data

Dec. 13, 1985 [DE] Fed. Rep. of Germany ..... 3544176

[51] Int. Cl.[4] ..... H01T 13/20; H01T 13/32; H01T 13/46

[52] U.S. Cl. ..... 313/130; 313/123; 313/131 R; 313/141

[58] Field of Search ..... 313/123, 130, 131 R, 313/140, 141, 142, 143, 144, 145, 118, 137, 131 A

[56] References Cited

U.S. PATENT DOCUMENTS

| | | | |
|---|---|---|---|
| 1,491,752 | 4/1924 | Richey | 313/142 |
| 3,517,247 | 6/1970 | Szilagyi | 313/143 X |
| 3,719,851 | 3/1973 | Burley | 313/123 |
| 3,911,307 | 10/1975 | Goto et al. | 313/143 |
| 4,337,408 | 6/1982 | Sone et al. | 313/130 |
| 4,354,136 | 10/1982 | Hamai et al. | 313/143 X |

*Primary Examiner*—Leo H. Boudreau
*Assistant Examiner*—Michael Horabik
*Attorney, Agent, or Firm*—Sixbey, Friedman, Leedom & Ferguson

[57] ABSTRACT

In a spark plug with combined surface and air spark paths comprising a center electrode, and insulator which surrounds the center electrode and which, at least in the end region of the center electrode, maintains a gap with respect thereto, and a ground electrode which, together with the spark plug body, surrounds the insulator and which at least in the end region of the insulator maintains a gap with respect thereto, the insulator, to form a discharge chamber surrounding the end portion of the center electrode, extends in the axial direction of the plug beyond the center electrode, and the ground electrode encompasses the insulator around the end thereof with an extension of the ground electrode extending into the discharge chamber with a clearance gap being maintained between the extension and the end portion of the insulator.

22 Claims, 5 Drawing Sheets

SPARK PLUG WITH COMBINED SURFACE AND AIR SPARK PATHS

Figure 1:
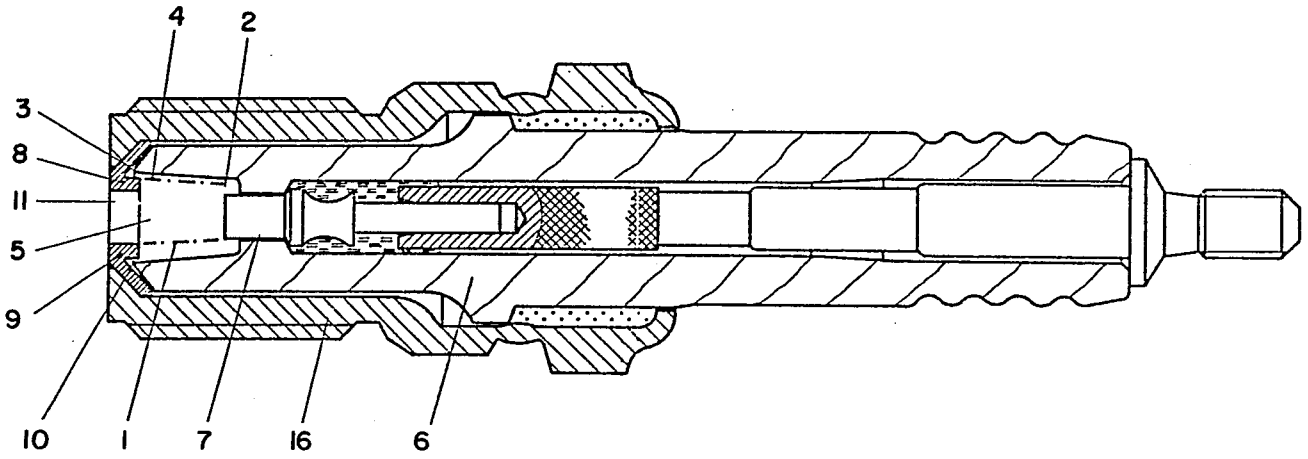

The invention relates to a spark plug with combined surface and air spark paths.

A spark plug of this type is known from DE-AS 1,272,043. In this known spark plug the air spark path and the air-surface-air spark path parallel thereto and alone effective under normal operating conditions lie in a plane perpendicular to the spark plug axis. The air-surface-air spark path extends over the edges of the insulator foot where particularly pronounced spark erosion takes place so that within a short time pronounced damage occurs to the spark plug insulator and a long life of the spark plug cannot be expected. In addition, in view of the design of the spark plug for voltages achievable with normal coil ignition system, the spark gaps are relatively short, and due to the relatively slow voltage rises at the spark plug capacitance in such ignition system and the arrangement of the air spark gap, as a rule, the air creepage air spark path is preferred. In particular, not enough spark energy which can be brought into the mixture to be ignited is available for igniting also leaner mixtures and spark-resistant mixtures.

DE-OS 3,022,549 discloses a plasma jet spark plug in which the insulating body extends in chamber form beyond the centre electrode and at its outer side is surrounded in direct contact with the ground electrode by the latter, the ground electrode forming the chamber opening. In this known spark plug, the spark runs along the insulator surface as surface or creepage spark and works its way at the contact edge of the insulator with the ground electrode, increasingly deeper into the insulator until the latter is so weakened that it breaks down.

The object of the invention is to provide a spark plug which, with an adequately rapid spark rise at the spark plug capacitance independently of the compression pressure of the mixture to be ignited, converts a large amount of ignition energy in the gas and achieves a long life in practice.

This object is accomplished acoording to the invention by a spark plug as defined in the claims.

Such an arrangement gives spark passages extending over the entire length of the discharge chamber and assuming an adequately rapid voltage rise at the spark plug capacitance as can be implemented, for example, and preferably, by means of a prespark ignition, i.e., a prespark gap lying in series with the spark plug spark gap in conjunction with a storage capacitor, the pure air spark being favoured even when the ignition voltage of the air spark gap, increasing with increasing pressure in the combustion chamber, already exceeds the ignition voltage of the surface or creepage spark path. Only when, with further increasing pressure in the combustion chamber, the ignition voltage of the air spark exceeds the voltage made available with very rapid rise at the spark plug capacitance and the voltage rise flattens out, does the parallel air-surface-air spark path take over the ignition. In the region of the very rapid voltage rise, conductive residues or shunts on the air-surface-air spark path are of no consequence so that here an unweakened pronounced formation of the air spark occurs.

Said spark jumps from the centre electrode onto the insulator wall, creeps along the latter and before reaching the insulator tip jumps over to the ground electrode surrounding said tip. A spark erosion at an insulator edge and thus damage to the insulator tip is therefore avoided. Another factor in eliminating spark erosion is for the insulator wall to be made as straight as possible, i.e., cylindrical or conical, because the spark can then creep without deflection. By providing an air spark gap at both ends of the surface spark path, the cathode drop of the discharge always lies in the gas chamber, even when the polarity of the voltage at the spark path changes by an electrical oscillation of the ignition system. In addition, an over-voltage present at the spark plug capacitance and typical of a prespark ignition results in the ignition energy being used substantially to build up the carrier avalanche of the plasma and is thus converted in the gas. The following arc and glow discharge is largely suppressed and consequently electrode burn-up is small and this also helps to increase the life.

this also helps to increase the life.

chamber has an opening that is narrowed with respect to its diameter. The discharge chamber thus becomes a prechamber in the true sense. The mixture entering the chamber on each compression stroke of the engine is ignited by the sparks which travel rapidly through the chamber over almost the entire length. The excess pressure thereby arising in the chamber ejects the ignited mixture far into the adjacent main combustion chamber and there forms, substantially in the centre in the combustion chamber, a large-volume inflamed zone from which the mixture continues to burn towards all sides at an elevated rate, and as a result, the paths to the combustion chamber walls are shortened and the flame front reaches the combustion chamber walls almost simultaneously and at all points earlier than with a conventional spark plug which ignites in the edge region of the combustion chamber.

A particular advantage also results, in this connection, from the rapid voltage rise at the spark plug. Simultaneously, several spark passages occur which jump over in the vicinity of the insulator surface of the discharge chamber or along the insulator surface. The chamber inner space is then surrounded by several plasma channels which each propagate themselves with a supersonic shock wave. Thus, due to consecutive shock waves, substantially in the centre near the chamber axis, for a short time, an appreciably increased pressure with increased temperature is generated and this, in turn, increases the ignition tendency of mixtures in this area or enables mixtures which are hard to ignite to be ignited at all. Moreover, the supersonic shock waves make the "shooting action" of such a spark plug considerable.

In a preferred embodiment of the invention, the opening of the discharge chamber is located eccentrically with respect to the axis of the discharge chamber. This provides turbulence of the gas in the discharge chamber so that any remaining old gas core and fresh gas are mixed in an optimum manner to give a mixture which is still ignitable.

In a preferred further development of the invention, a further prechamber is provided which is connected via an opening to the discharge chamber and has dimensions larger than the latter. This makes adaptation possible to differently sized and differently shaped main combustion chambers.

In a further preferred development of the invention, a centre electrode is provided which has low resistance for high voltages applied thereto and high resistance for low voltages applied thereto. A material advantageous in this context for the centre electrode is silicon carbide.

In operation of a spark plug with conventional electrode material in a prespark ignition arrangement, after completion of the breakdown phase, as mentioned above, electrical oscillations can be expected whose voltage amplitude in the opposite direction can be considerable. Such oscillations, which are undesirable both for energy conversion and for spark interference reasons, should be suppressed as far as possible.

If, for the spark plug, a centre electrode of silicon carbide is provided, then remote from the voltage zero passage at the electrode, the electrical resistance thereof is low (in the ohm ranges), but near the zero passage many times higher (in the kiloohm range). Thus, with optimum design, an almost aperiodic damping can be achieved without any overshoot.

According to a further preferred development of the invention, the air spark gap, but not the air-surface-air spark path lies, in series with a resistance. Then, although during the steep voltage rise on breakdown the air spark gap is preferred, the current is so restricted that even after sparkover at least, at times, more charge flows to the spark plug capacitance from the charge storage means (storage capacity) via the prespark path than is withdrawn via the air spark gap to the ground electrode). The voltage at the spark plug thus increases further, although with less steepness, and as a result sparkovers also occur across the air-surface-air spark path via which the spark plug capacitance and the storage capacitor discharge. This again results in several surface spark channels simultaneously, which each spread with a supersonic shock wave. The shock waves meet again in the axis of the discharge chamber and thereby act, not only on the air or the fuel-air mixture, but also on the already ignited air spark burning as arc. The air spark is engaged by the gas flow, drawn increasingly further apart and curving itself blown into the actual combustion chamber until it finally breaks away. This increases the chances of also including ignitable mixture outside the discharge chamber.

According to an advantageous embodiment of the invention, to form the series resistance, a centre electrode is provided with a poorly conductive core and a good conducting surface, the good conducting surface being remote from the centre electrode in the initial region of the air spark gap.

In an advantageous further development of the invention, the centre electrode of poor conductivity in the core and good conductivity at the surface can be implemented by silicon -carbide which is surface doped to give a good surface conductivity.

Figure 2:
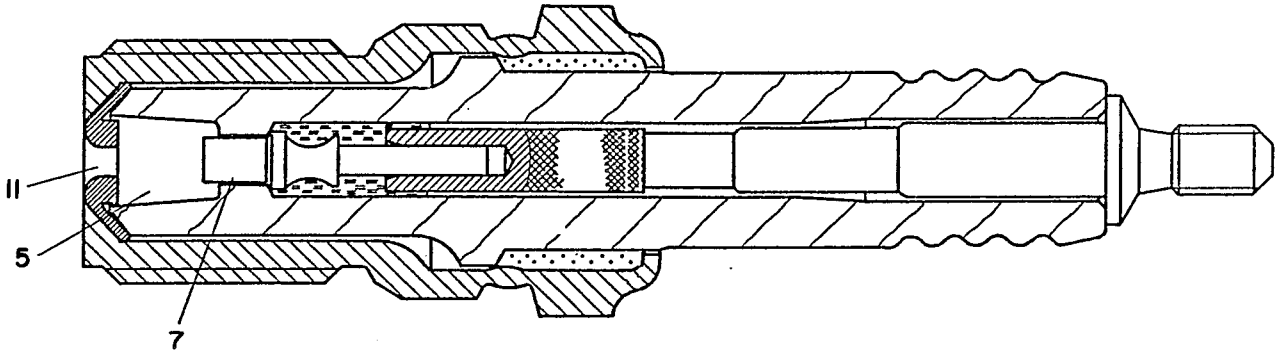
Figure 3:
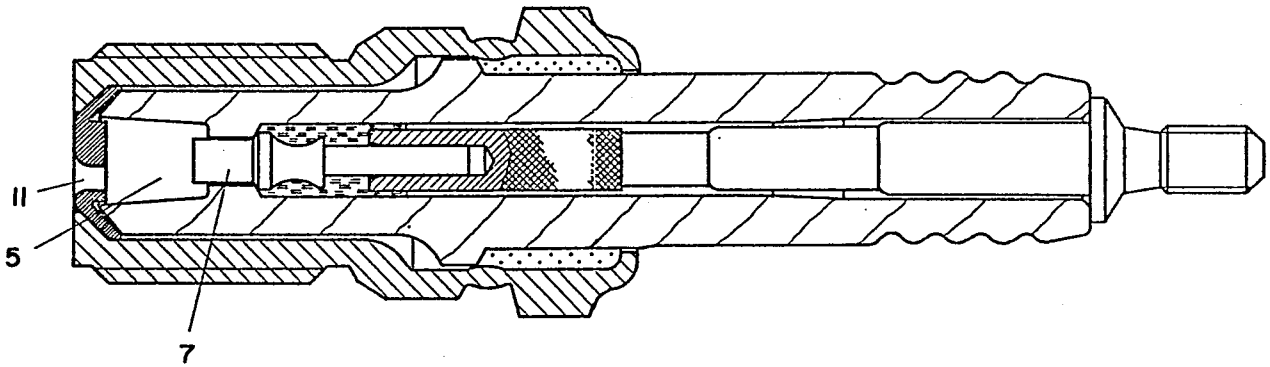
Figure 4:
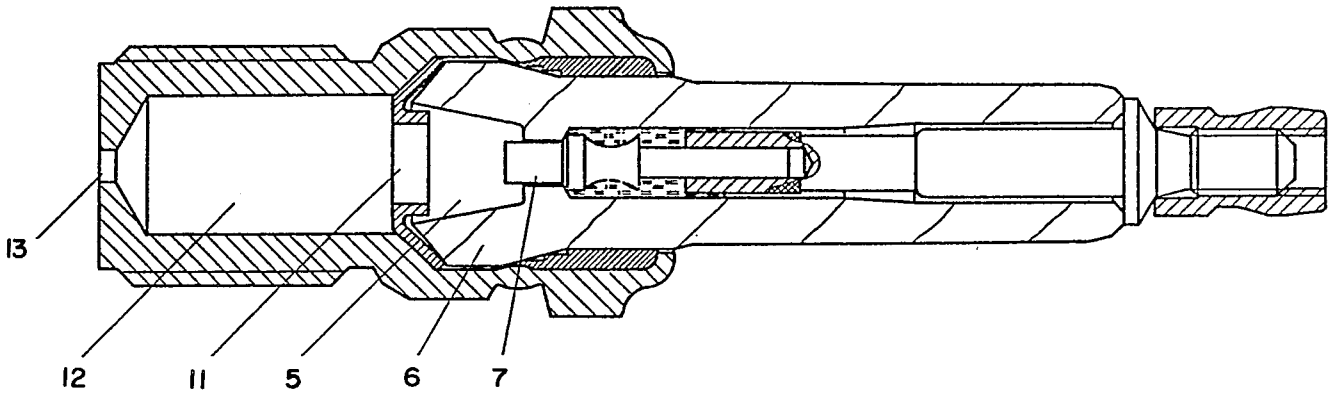
Figure 5:
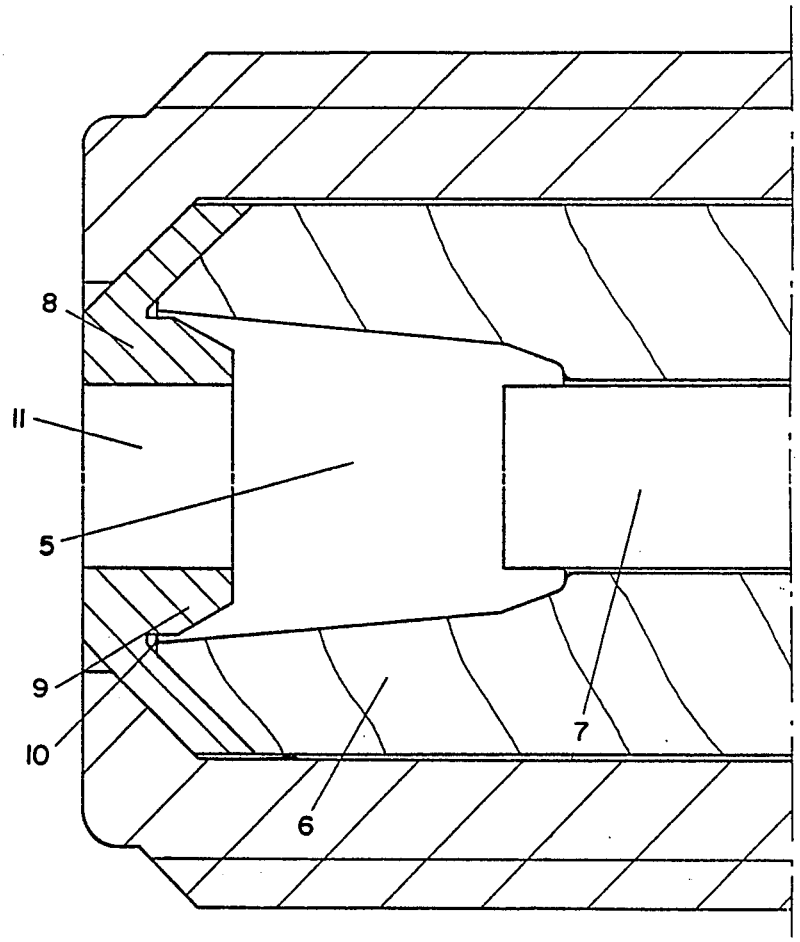

Hereinafter embodiments of the invention will be described with the aid of the attached drawings of which, in each case in longitudinal section, FIG. 1 shows a first embodiment of the spark plug according to the invention, FIG. 2 shows a second embodiment thereof with a differently formed exit opening of the discharge chamber, FIG. 3 shows a further embodiment thereof with an eccentrically disposed exit opening of the discharge chamber, FIG. 4 shows a further embodiment thereof with a further prechamber following the discharge chamber and FIG. 5 is a detail view of the tip of the spark plug according to another embodiment.

FIG. 1 shows, in longitudinal section, a spark plug having a centre electrode 7, a spark plug insulator 6 disposed therearound and a spark plug body 16 surrounding said insulator and simultaneously forming or carrying the ground electrode 8.

The spark plug insulator 6 is so formed in its foot portion that it extends beyond the end of the centre electrode 7 and thus forms a discharge chamber 5 with, in this case, a conical wall, although another possibility is to have, cylindrical or, also, concave walls. The end of the insulator 6 remote from the centre electrode 7 is surrounded, with maintenance of an annular gap, by the actual ground or body electrode 8, which is connected to the spark plug body 16 and which is made of material particularly resistant to burning off. It is important that the body electrode 8, with its extension 9, surrounds the insulator tip 10 in such a manner that (seen along the inner wall surface of the chamber-forming insulator, it ends closer to the centre electrode 7 than the insulator.

The rod-shaped centre electrode 7 projects, at the most and preferably, slightly, i.e., 1–2 mm, preferably 1 mm, with a chamber length of 4–10 mm, preferably about 7 mm, into the discharge chamber 5.

This arrangement provides an air gap path 1 which extends directly from the centre electrode 7 to the ground electrode 8. Parallel thereto there is an air-surface-air spark path 2, 4, 3 having an air gap portion 2 which extends from the portion of the centre electrode 7 projecting into the discharge chamber 5 to the insulator wall, a following surface path portion 4 and a further air spark portion 3 extending from the insulator wall to the ground electrode. Through the extension 9 of the ground electrode 8 placed round the insulator tip 10, the air gap path 3 does not originate from the insulator tip, but from the insulator wall, thus avoiding damage to the insulator edge impairing the life of the spark plug.

Due to the at the most slight projection of the rod-shaped centre electrode 7 into the discharge chamber 5, sparks form in a large volume over the entire length of the discharge chamber.

The ground electrode 8 forms an opening 11 through which the ignited mixture emerges into the main combustion chamber.

If in accordance with FIG. 2 this opening 11 is substantially diminished, under the secondary condition that adequate ignitable mixture can still pass through, then on ignition of the mixture in the discharge chamber 5, a pressure arises which is so high that the ignited mixture is ejected through this diminished opening 11 far into the main combustion chamber. By an optimum matching of the magnitude of the discharge chamber 5 to the form and volume of the main combustion chamber, a large volume inflamed zone is formed, substantially in the centre of the main combustion chamber, starting from which the mixture burns towards all sides at an elevated burning rate up to the combustion chamber wall. In an ideal case, the flame front arrives at the combustion chamber wall in all areas substantially simultaneously, less energy being dissipated via the combustion chamber wall and the engine efficiency being improved.

The mixture entry into the discharge chamber 5 via the bore 11 can be improved by a nozzle-shaped formation thereof.

In the embodiment of the spark plug according to FIG. 3, the opening 11 of the discharge chamber 5 is asymmetrically disposed. As a result, in the discharge chamber 5, turbulence can be generated so that the old gas core and fresh gas are mixed in an optimum manner. By high ignition energy, for example, using a prespark ignition, it is then possible to ignite this lean mixture.

In the embodiment of the spark plug according to FIG. 4, the discharge chamber 5 opens into a further larger prechamber 12, with a further opening 13 opening into the discharge chamber and formed as a shooting passage bore. The opening 11 of the discharge chamber 5 can again be formed as one of the variants illustrated in the preceding Figures.

The centre electrode 7 consists, in the embodiments illustrated, preferably of silicon carbide which has a low resistance for high applied voltages and a high resistance for low applied voltages so that an electrical oscillation of the ignition system is suppressed in favour of a damping which is aperiodic in the ideal case. As a result, when using a prespark ignition, the capacitor discharge current will always flow in the same direction, the polarity will not change, the conductive prespark path will remain of low resistance and the energy conversion will take place, as desired, mainly at the spark plug gap. This moreover simplifies the spark interference suppression means.

Preferably, an ohmic resistance lies in series with the air spark path 1 but not the combined air-surface-air spark path 2, 4, 3. Because then, with a rapid voltage rise, although the air spark gap is always preferred, the current remains restricted so that, after strikeover of the air spark path the voltage at the spark plug capacitance initially continues to rise, although with a lesser steepness, as a result the air-surface-air spark paths 2, 4, 3 are also ignited.

To provide this ohmic resistance lying in series only with the air spark gap, a centre electrode 7 of silicon carbide is provided which has a surface doping which imparts to it, in the doped region, a particularly good conductivity, the well doped surface layer being removed in the region of the starting points of the air spark paths 1, but left in the region of the starting points of the air creepage air spark paths 2, 4, 3.

FIG. 5 shows, in longitudinal section, the tip of a spark plug according to a further embodiment. The discharge chamber 5 has a substantially conical outer wall which is made up of two conical portions, the portion disposed in the region of the projecting part of the centre electrode 7 being more inclined to the cone axis than the remaining portion.

The extension 9 of the body electrode 8 extending around the spark plug insulator 6 is likewise made conical at the outside of its portion projecting into the discharge chamber 5, with a greater inclination angle than the outer wall of the discharge chamber 5 in this region so that, between the extension 9 and the wall of the discharge chamber, an annular gap is formed which has a width decreasing towards the bottom thereof. An annular gap with its width decreasing towards the bottom thereof is also present between the portion of the cylindrical centre electrode 7 projecting into the discharge chamber 5 and the conical wall of said discharge chamber 5.

In this manner, for every gas pressure obtained in the discharge chamber 5, optimum possibilities are present for an air-surface-air spark path. At low pressure, the air spark gaps are large, i.e, the spark jumps in the region of the large width of the annular gap from the centre electrode 7 over to the insulator 6, then runs as surface spark along the insulator surface and, for jumping over to the extension 9, detaches from the insulator 6 again in the region of the large width of the annular gap between said insulator 6 and extension 9.

For high pressures in the discharge chamber 5, however, the air spark gaps are short, i.e. the air spark strikeovers between the centre electrode 7 and insulator 6, on the one hand, and insulator 6 and extension 9, on the other, take place in the bottom region of the respective annular gap, the surface spark path being correspondingly longer.

With regard to the magnitude ratios, typically the length of the discharge chamber measured in the axial direction from the bottom of the one annular gap to the bottom of the other annular gap is between 4 and 10 mm, preferably about 7 mm, and the annular gaps themselves have a depth between 0.5 and 1.5 mm, preferably about 1 mm, and in the upper region are between 0.4 and 1 mm wide and in the bottom region between 0.05 and 0.2 mm wide.

The diameter of the centre electrode 7 is preferably about 3 mm; the diameter of the opening 11 corresponds to about that of the centre electrode.

It should moreover, be observed that the insulator 6 further extends beyond the bottom of the conical annular gap between the extension 9 and insulator 6 to be more certain that the air gap does not jump over to the insulator tip 10. The conical annular gap between the extension 9 and insulator 6 is thus followed on the bottom side by a cylindrical annular gap whose width corresponds to the bottom width of the conical annular gap. Similar conditions are also present in this respect between the centre electrode 7 and insulator body 6.

The spark plug insulator 6 also maintains, in the embodiments illustrated, an annular gap with respect to the spark plug body 16 continuing in the body electrode 8. In the region of this annular gap, the insulator is metallized on the surface giving an increased transverse capacitance which results in a reduced ignition voltage.

The present spark plug functions, as already mentioned, preferably in conjunction with a prespark ignition (e.g. capacitor of 250 pF discharging via 25 kV spark gap), but on the other hand also when a capacitor (e.g. 250 pF) is discharged without prespark path via the ignition spark path, less energy then, however, passing into the gas because the voltage excess at the ignition spark path is lacking. The prespark ignition is also advantageous because creepage paths on insulators fluctuate greatly in their surface resistance, for example, from a few ohms to a few megohms, and this is no trouble when employing a prespark ignition.

We claim:

1. A spark plug with combined surface and air spark paths, comprising a spark plug body, a centre electrode having an end portion, an insulator surrounding the centre electrode, and a ground electrode which, together with said spark plug body, surrounds the insulator, said insulator maintaining a gap at least with respect to said end portion of said centre electrode and extending beyond said centre electrode in an axial direction of said spark plug for forming a discharge chamber surrounding said end portion of said centre electrode; said ground electrode surrounding the insulator around an end portion thereof with an annular gap therebetween and having an annular extension extending parallel to the longitudinal axis of said spark plug into the discharge chamber in a manner such that the extension is spaced from and surrounds a tip of the insulator.

2. Spark plug according to claim 1 wherein the discharge chamber has an opening that has a narrower diameter than the dicharge chamber itself.

3. Spark plug according to claim 2, wherein the opening is made nozzle-like.

4. Spark plug according to claim 2, wherein the opening is disposed eccentrically with respect to a longitudinal axis of the discharge chamber.

5. Spark plug according to claim 2, wherein a prechamber is provided which is connected via the opening to the discharge chamber and has greater dimensions than the latter.

6. Spark plug according to claim 1, wherein the gap formed between the extension of the ground electrode and the end portion of the insulator has a cross-sectional width that decreases in a direction toward a junction between the ground electrode encompassing around the insulator and the extension extending into the discharge chamber.

7. Spark plug according to claim 2, wherein the gap formed between the centre electrode and the insulator has a cross-sectional width decreasing towards a point at which the insulator meets the centre electrode.

8. Spark plug according to claim 2, wherein the opening is disposed eccentrically with respect to a longitudinal axis of the discharge chamber.

9. Spark plug according to claim 3, wherein a prechamber is provided which is connected via the opening to the discharge chamber and has greater dimensions than the latter.

10. Spark plug according to claim 4, wherein a prechamber is provided which is connected via the opening to the discharge chamber and has greater dimensions than the latter.

11. Spark plug according to claim 2, wherein a centre electrode is provided which is of low resistance for high voltages applied thereto and of high resistance for low voltages applied thereto.

12. Spark plug according to claim 2, wherein an air spark path from the centre electrode to the ground electrode but not an air-surface-air spark path from the centre electrode to the insulator to the ground electrode lies in series with an ohmic resistance.

13. Spark plug according to claim 12, wherein to form the series resistance a centre electrode is provided having a core of a material having sufficiently high resistance per unit length or volume to function as an electrical resistor and a surface region having good conductivity relative to that of the core material and suitable for carrying electric current, the surface region of good conductivity not being present in the vicinity of said end region.

14. Spark plug according to claim 2, wherein the gap formed between the extension of the ground electrode and the end portion of insulator has a cross-sectional width that decreases in a direction toward a junction between the ground electrode encompassing around the insulator and the extension extending into the discharge chamber.

15. Spark plug according to claim 2, wherein the gap formed between the centre electrode and the insulator has a cross-sectional width decreasing towards a point at which the insulator meets the centre electrode.

16. Spark plug according to claim 2, wherein said opening of the discharge chamber is formed by the extension of the ground electrode.

17. A spark plug with combined surface and air spark paths, comprising a spark plug body, a centre electrode having an end poriton, an insulator surrounding the centre electrode, and a ground electrode which, together with said spark plug body, surrounds the insulator, said insulator maintaining a gap at least with respect to said end portion of said centre electrode and extending beyond said centre electrode in an axial direction of said spark plug for forming a discharge chamber surrounding said end portion of said centre electrode; said ground electrode encompassing the insulator around an end portion thereof and having an extension extending into the discharge chamber, a gap being maintained between the extension of the ground electrode and said end portion of said insulator, wherein a centre electrode is provided which is of low resistance for high voltages applied thereto and of high resistance for low voltages aplied thereto.

18. Spark plug according to claim 17, wherein the centre electrode is of silicon carbide.

19. A spark plug with combined surface and air spark paths, comprising a spark plug body, a centre electrode having an end poriton, an insulator surrounding the centre electrode, and a ground electrode which, together with said spark plug body, surrounds the insulator, said insulator maintaining a gap at least with respect to said end portion of said centre electrode and extending beyond said centre electrode in an axial direction of said spark plug for forming a discharge chamber surrounding said end portion of said centre electrode; said ground electrode encompassing the insulator around an end portion thereof and having an extension extending into the discharge chamber, a gap being maintained between the extension of the ground electrode and said end poriton of said insulator, wherein an air spark path from the centre electrode to the ground electrode but not an air-surface-air spark path from the centre electrode to the insulator to the ground electrode lies in series with an ohmic resistance.

20. Spark plug according to claim 19, wherein, to form the series resistance, a centre electrode is provided having a core of a material having sufficiently high resistance per unit length or volume to function as an electrical resistor and a surface region having good conductivity relative to that of the core material and suitable for carrying electric current, the surface region of good conductivity not being present in the vicinity of said end region.

21. Spark plug according to claim 20, wherein the centre electrode consists of a body of silicon carbide, to which a material has been added in said surface region to increase the electrical conductivity of the centre electrode in said surface region relative to that of the silicon carbide.

22. Spark plug according to claim 20, wherein the resistivity of the core is in a kiloohm range and that of the surface region is in an ohm range.

* * * * *